US005526755A

United States Patent [19]

Dalrymple

[11] Patent Number: 5,526,755

[45] Date of Patent: Jun. 18, 1996

[54] HIGH ADHESION MAGNETIC RAIL

[76] Inventor: James G. Dalrymple, 1536 - 137th Ave., San Leandro, Calif. 94578

[21] Appl. No.: 519,550

[22] Filed: Aug. 25, 1995

[51] Int. Cl.[6] ..... B61C 11/00

[52] U.S. Cl. ..... 105/77; 238/122; 238/127; 238/142

[58] Field of Search ..... 105/73, 77, 78; 188/164, 165; 238/14.3, 122, 127, 134, 135, 142

[56] References Cited

U.S. PATENT DOCUMENTS

| | | | |
|---|---|---|---|
| 441,828 | 12/1890 | Dewey | 105/77 |
| 845,147 | 12/1904 | Vandergrift | 238/142 |
| 1,077,236 | 10/1913 | Weeber | 238/134 |
| 1,894,513 | 1/1933 | Grondahl | 105/77 |
| 3,111,265 | 11/1963 | Huber | 105/77 |

*Primary Examiner*—S. Joseph Morano
*Attorney, Agent, or Firm*—Linval B. Castle

[57] ABSTRACT

A magnetized rail for improving the adhesion between the rail and the steel wheels of a rail car will help prevent skidding of the rail car when decelerating from a high speed. The rail is split with an air gap in the rail head and a electromagnet coupled between the split webs of the rail.

8 Claims, 1 Drawing Sheet

HIGH ADHESION MAGNETIC RAIL

This invention relates to rails and particularly to a high adhesion magnetic rail for reducing skidding when brakes are applied in rail cars or slipping when climbing a grade.

BACKGROUND OF THE INVENTION

The high speed or rapid transit system is becoming increasingly popular for moving relatively large masses of people between towns and into cities. The electrically driven rail cars are fast, quiet, comfortable and don't contribute to air pollutions that threatens large metropolitan areas. Mechanically, the rail cars used by the rapid transit systems are light weight and powerful enough for use in reasonably hilly areas. However, one of their drawbacks is that their light weight and high speed gives them a tendency to slip on their rails when brakes are applied, or when starting from a stop to climb a grade.

Slipping on the rails when brakes are applied is not the fault of the brakes since the combination of electrical braking, which is used to slow the rail cars from a high speed, and mechanical braking after the cars have been slowed, is quite adequate. The slippage is due to the interface of a steel wheel on a steel rail. This slippage is not found in the much slower "trolley" or street cars, nor in the very heavy locomotives during braking because their weight demands a gradual slowing when stopping.

The high speed, light weight rail cars accelerate quickly to speeds up to about 80 miles per hour and are designed to achieve a deceleration rate of about 3 miles per hour per second (3 mi/hr/sec) when stopping. This deceleration rate is obtainable from a fairly low speeds of perhaps 35 miles per hour but as the speed is increased, the deceleration rate decreases so that at a speed of around 70 miles an hour, the rate may have dropped to 2 mi/hr/sec. If any attempt is made to slow down faster, it probably will result in a skid along the rails.

Another factor contributing to skidding is a track that is wet or frosty. When this occurs, a deceleration rate much less that 2 mi/hr/sec results. Therefore, while the brakes function properly and can easily stop the wheels from rotating, something is needed that makes the decelerating rotating steel wheels adhere to the steel rails. This is the function of the present invention.

The fundamental object of the invention is to improve adhesion between a steel rail and a steel wheel on a rail car for preventing or reducing skidding. This becomes exceedingly important when a rail car is approaching a stop at the bottom of a grade or climbing a grade after having stopped at the bottom. Improving adhesion between rail and wheels will result in faster trains with faster stops and therefore the passage or more passengers per hour.

Briefly described, the present invention is for a magnetic rail that may be installed along areas where rail skidding normally occurs. The preferably electromagnetic rail, when energized, will forcibly attract the steel wheel to it to prevent any slippage between them during braking of acceleration of the wheel.

DESCRIPTION OF THE DRAWINGS

In the drawings which illustrate the preferred embodiment of the invention.

DETAILED DESCRIPTION

The purpose of the invention is to increase adhesion between the steel rails and the steel wheels of a rail car to prevent skidding between them when the rail car is accelerating or braking. This is accomplished by installing magnetized rails, made in accordance with the invention, in those areas where skidding is likely to occur. For example, maximum braking may be necessary for a rapid transit train to make a passenger stop at the bottom of a steep grade.

Figure 1:
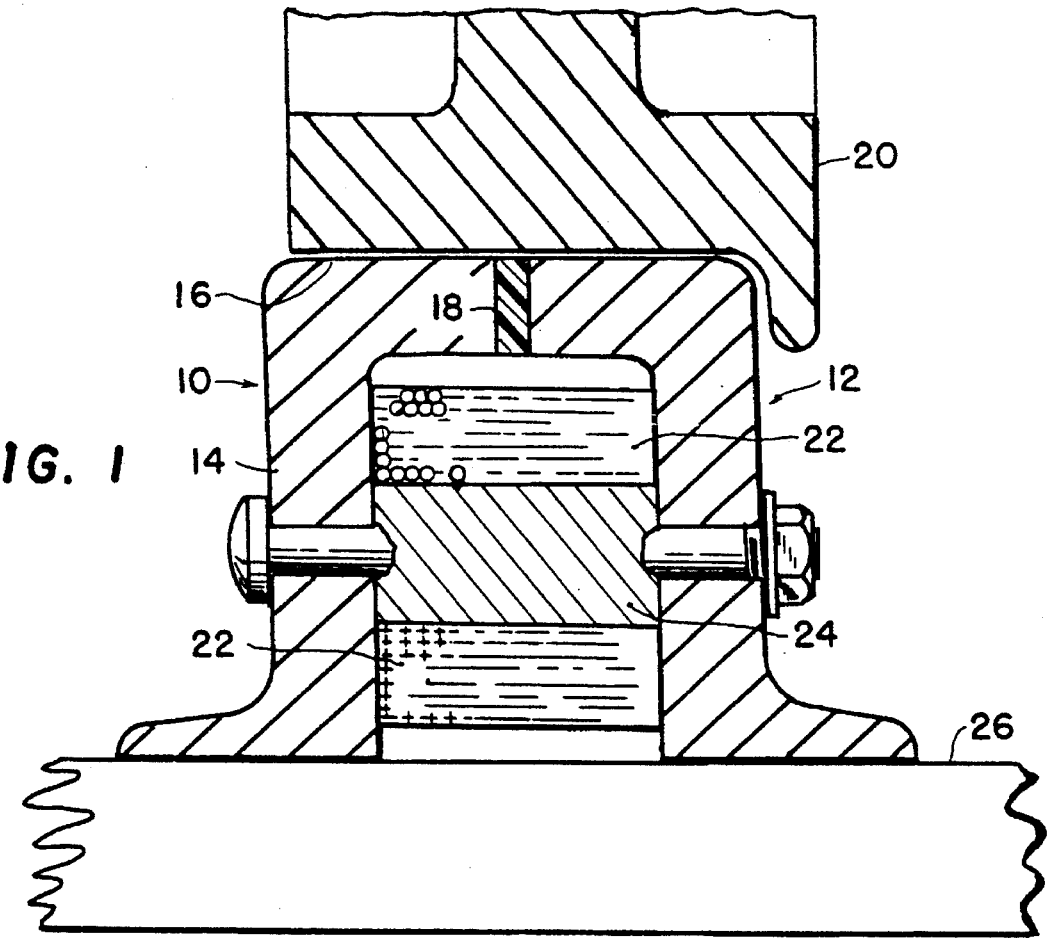
FIG. 1 is a sectional elevational end view of a electromagnetized rail.

The preferred embodiment of the magnetized steel rail is illustrated in the sectional drawing of FIG. 1. Instead of the conventional inverted "T" rail, the magnetized rail is comprised of two identical specially shaped rail sections 10, 12 each having a vertical web section 14 with an inward-turning, flat topped head 16. The two inward-turning heads of the two rail sections face each other and are separated by an air gap 18 that may be filled with a plastic or other non magnetic substance. The width of the air gap 18 is normally about ¾ inches but may be varied according to the required magnetic density and the adhesion necessary to prevent slippage of the wheel 20 during rotational acceleration and deceleration.

The rail may be permanently magnetized but the preferred rail is electromagnetized with a direct current flowing through a large wire coil 22 wrapped around an iron core 24 that is bolted or otherwise held in contact with both webs 14 of the rail sections 10, 12. Only one of the core and coil combinations is illustrated in FIG. 1; it is contemplated that similar magnetic cores and coils should be placed about every two to three feet apart along a section of rail, depending upon several factors including: the length of the rail section normally subject to skid, the grade and its length, the normal train speed at the point of potential skid.

The two sections 10, 12 are secured in the normal manner to a nonmagnetic tie 26.

It can be seen that, when energized with an appropriate current through the coil, the magnetic flux thus generated passes through one pole of the core 24 and up steel web 14 and through the rail head 16. If a steel wheel 20 is not present, the flux jumps the air gap 18 and passes down through the opposite rail section into the opposite pole of the core 24. When a steel wheel 20 is present, it short circuits the air gap and the flux much more readily passes through the wheel, much as if one were to put a "keeper" on the end of a "horseshoe" magnet.

Figure 2:
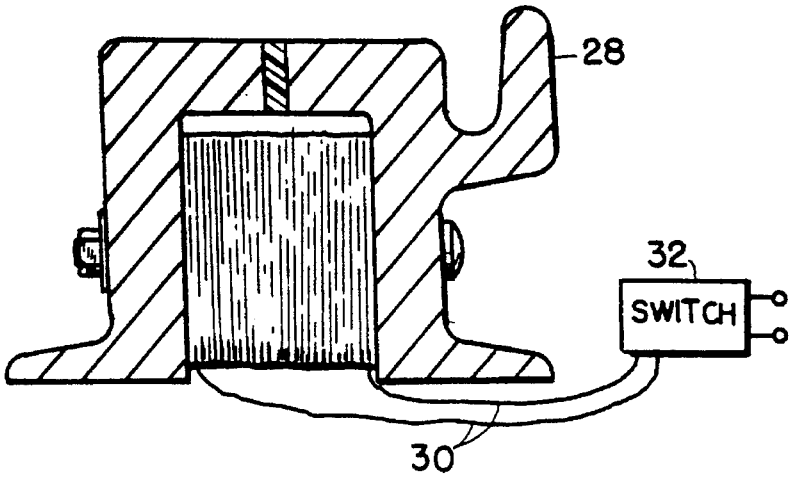
FIG. 2 is a sectional elevational end view of another embodiment of a magnetized rail with a safety flange.

FIG. 2 illustrates a similar rail section, but formed with a safety flange 28 on one of the rails for engaging a wheel flange and for preventing side skidding of the wheel from the rail. FIG. 2 also shows the energizing wires 30 to the coil between the two rail sections and a power switch 32 for controlling the electric power to the wires. The switch may be controlled remotely from inside a rail car, or could be activated externally by photocell. However, it is believed to be best contemplated that switch 32 is controlled in a manner similar to the control of a block signal in which a length of rail subject to skid is electrically isolated, and is short circuited by the passage of rail cars, the short circuit thus providing an electrical signal which, in turn, causes the switch 32 to become activated while a rail car is present.

I claim:

1. A steel rail for preventing skidding of a rail car by improving adhesion between said rail and steel wheels on the rail car, said rail comprising;

first and second sections of said rail, each of said sections having a vertical web and a flat-topped, inward-turned head portion overlying said vertical web, each web of said sections being secured at its lower end to a non-magnetic tie, an air gap between and separating said head portions; and a magnet, each pole of said magnet connected to one of said vertical webs.

2. The rail claimed in claim 1 wherein said magnet is an electromagnet.

3. The rail claimed in claim 1 wherein said air gap is filled with a nonmagnetic material.

4. The rail claimed in claim 2 wherein said electromagnet is bolted between said vertical webs.

5. The rail claimed in claim 2 wherein said electromagnet is energized by a D.C. source controlled by switching means.

6. The rail claimed in claim 5 wherein said switching means is controlled by block signal circuitry coupled across rails.

7. The rail claimed in claim 5 wherein said switching means is controlled by photocell means.

8. The rail claimed in claim 2 wherein one of said rail sections has a safety flange for engaging a wheel flange on a rail car.

* * * * *